US007143601B1

(12) United States Patent
Jimenez

(10) Patent No.: US 7,143,601 B1
(45) Date of Patent: Dec. 5, 2006

(54) COOLER AND UMBRELLA ASSEMBLY

(76) Inventor: Joaquin Jimenez, 359 W. 15th St., Hialeah, FL (US) 33010

( * ) Notice: Subject to any disclaimer, the term of this patent is extended or adjusted under 35 U.S.C. 154(b) by 0 days.

(21) Appl. No.: 10/836,719

(22) Filed: Apr. 30, 2004

(51) Int. Cl.
*F25D 3/08* (2006.01)

(52) U.S. Cl. ..... 62/457.7; 136/16; 220/592.03

(58) Field of Classification Search .... 62/457.1–457.9, 62/529, 530, 371; 135/16; 206/216, 427; 220/592.03
See application file for complete search history.

(56) References Cited

U.S. PATENT DOCUMENTS 5,235,822 A * 8/1993 Leonovich, Jr. ..... 62/457.2
5,249,438 A * 10/1993 Rhaney et al. ..... 62/457.7
5,269,157 A * 12/1993 Ciminelli et al. ..... 62/457.7
5,275,018 A 1/1994 Lin
5,313,817 A 5/1994 Meinders
D349,215 S 8/1994 Mercado
5,781,853 A 7/1998 Johnson
5,979,175 A 11/1999 Ellison
6,216,488 B1 4/2001 Rucker
6,474,097 B1 * 11/2002 Treppedi et al. ..... 62/457.7
D467,770 S 12/2002 Blalock
6,554,012 B1 * 4/2003 Patarra ..... 135/16
6,595,016 B1 * 7/2003 Demirkiran ..... 62/236

* cited by examiner

*Primary Examiner*—William E. Tapolcai

(57) ABSTRACT

The cooler is a standard piece of recreational equipment. This device combines the utility of a cooler with an umbrella, a radio, speakers, and a bottle opener. Because this device combines all three functions in one device the consumer is not required to purchase or carry each item separately. A handle and wheels have been installed on this device to allow the user an easy way to transport this device.

5 Claims, 3 Drawing Sheets

COOLER AND UMBRELLA ASSEMBLY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

1. Field of the Invention

This invention combines a cooler, beach umbrella and entertainment center into one device. This device eliminates the necessity of carrying a cooler, an umbrella and a radio to the beach as separate items but instead combines them.

2. Prior Art

One of the difficulties in going to the beach, a park or other outdoor arena is carrying the drinks, the umbrella and the entertainment. Typically, this requires multiple trips to the car.

Representative examples of the prior art include Johnson, U.S. Pat. No. 5,787,853, Lin, U.S. Pat. No. 5,275,018 and Rucker, U.S. Pat. No. 6,216,488. While these patents attempt to accomplish the stated goal of avoiding multiple trips to the car, multiple trips will still be required with each of these devices.

BRIEF SUMMARY OF THE INVENTION

This device combines a cooler, an umbrella and an AM/FM radio with a possible CD player into one device. This will make it extremely convenient for the recreational consumer to have everything that he or she needs in one device.

This is a standard cooler with come extra features. The cooler part of the device is opened and closed using a latch on the front and a hinge on the back of the top panel. Access to the cooler is not changed by this device.

The device is equipped with wheels on the back end of the unit and a handle on the front panel has been added to allow the device to be easily pulled from place to place. The wheels are oversized and preferably made from hard plastic to accommodate a variety of terrains.

An umbrella is added as part of the device. Instead of carrying a separate umbrella the device houses one. The height of the umbrella can be adjusted by means of a telescoping tube. A latch on the back panel of this device houses the umbrella when the umbrella is retracted and in the closed position.

On the front panel a bottle opener is installed to allow the user to open drinks. On that same panel the radio with CD player is installed within the front panel of the device. Speakers are installed as well on either side of the radio with a CD player.

The device combines multiple functions within one unit unlike the prior art, which segregates the functions.

DETAILED DESCRIPTION OF THE EMBODIMENT

Figure 1:
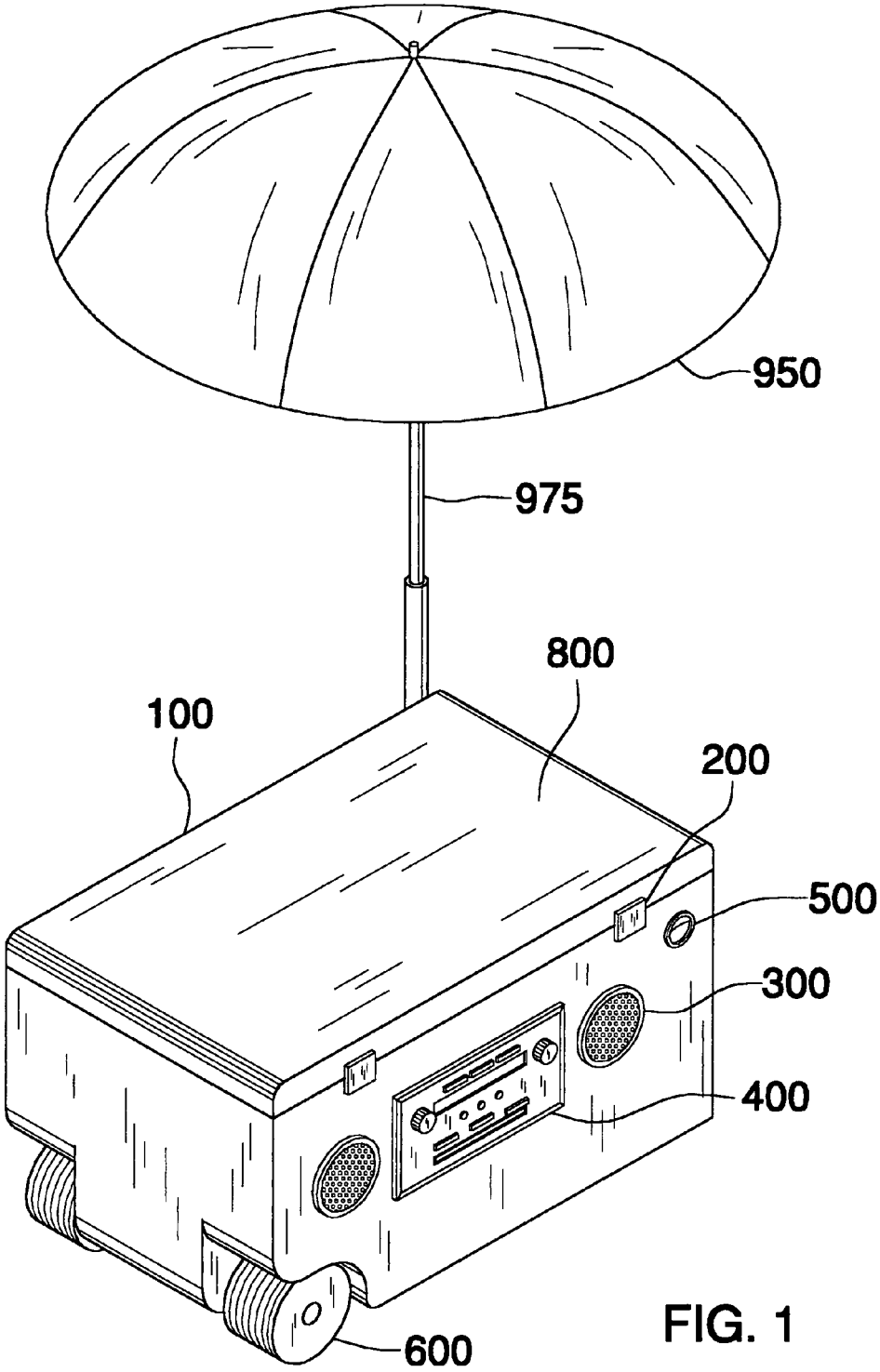
FIG. 1 is a perspective view of the device from the front.

According to FIG. 1, this device combines the utility of a cooler with an umbrella and also an AM/FM radio with CD player. The access to the cooler 100 is via a top lid 800 as is found in many coolers. Access to the cooler is not altered by this device. It is anticipated that the will be manufactured from plastic for durability.

The cooler 100 consists of a top lid 800, which is hinged on the first side of the top lid 800 and is equipped with latches 200 on the second side. Two latches are drawn on FIG. 1 although one latch may be used. This allows the lid 800 to be opened to a position roughly perpendicular to the sides of the cooler.

An AM/FM radio and CD player with speakers 300 is on the front of the unit. FIG. 1 Two speakers 300 have also been installed on the front of the device. An AM/FM radio with CD player 400, which is installed directly into the device, is positioned between the speakers on the front surface. In addition to the radio and speakers a bottle opener 500 is installed in the upper right hand corner of the front side of the device to allow bottles to be opened. The exact position of the bottle opener may be located in different locations on the cooler.

Wheels 600 have been installed on the back lateral side of the device to permit easy travel over all types of terrain.

The wheels are inserted into a recessed well to enable the wheels to remain flush with the sides on the unit and allow the device to maintain a roughly rectangular shape. The wheels are oversized and preferably plastic to enable the device to be pulled over all terrains.

Figure 2:
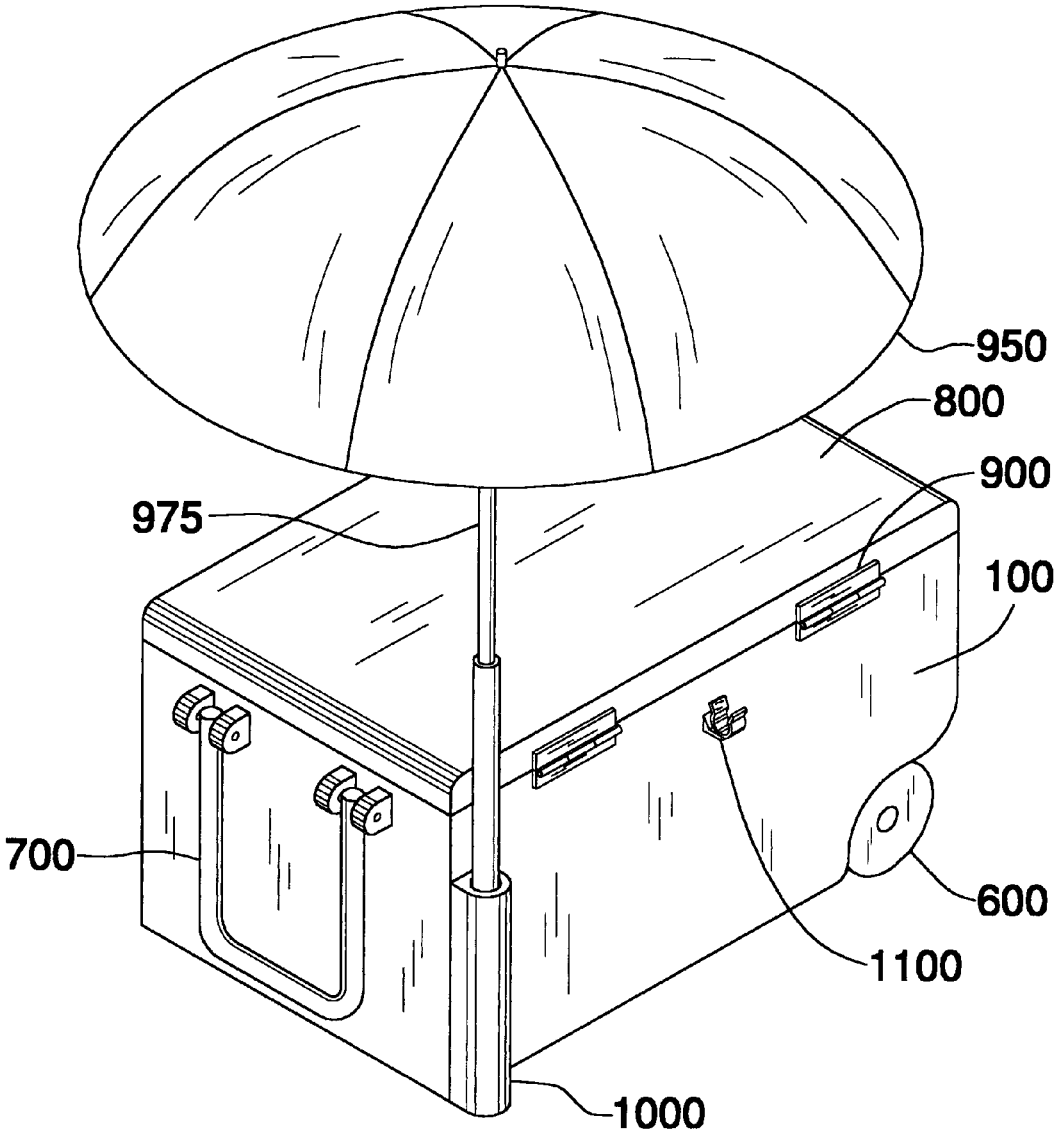
FIG. 2 is a perspective view of the device from the back.

FIG. 2 is a reverse view of FIG. 1 which depicts a handle 700 that is located on the front side panel and allows the device to be pulled. The wheels 600 save the consumer from lifting the device.

The lid 800 of the cooler is opened by opening the latches 200 on the top of the side panel above the AM/FM radio or CD player 400. FIG. 1.

On the back side of the cooler top are hinges 900 which allow the top or lid 800 to swing open and assume a vertical position, if necessary, to allow access to the contents of the cooler. The hinges 900 are located on the back and allow the top or lid to swing open and shut. FIG. 2 Although hinges 900 are shown, other types of connection devices such as a single molded seam may be used.

An umbrella 950 is installed and depicted in the open position in FIG. 1. A telescoping tube 975, which is secured at one end to the umbrella 950 and at the other end to the umbrella housing 1000 allows the umbrella's height to be adjusted and maintains the umbrella with the device. The umbrella when it is retracted sits within an umbrella housing 1000 which is located on the back panel of this device and is molded as a part of this device. The umbrella, when it is opened, will allow the lid 800 of the cooler to be opened to gain access to its contents.

Figure 3:
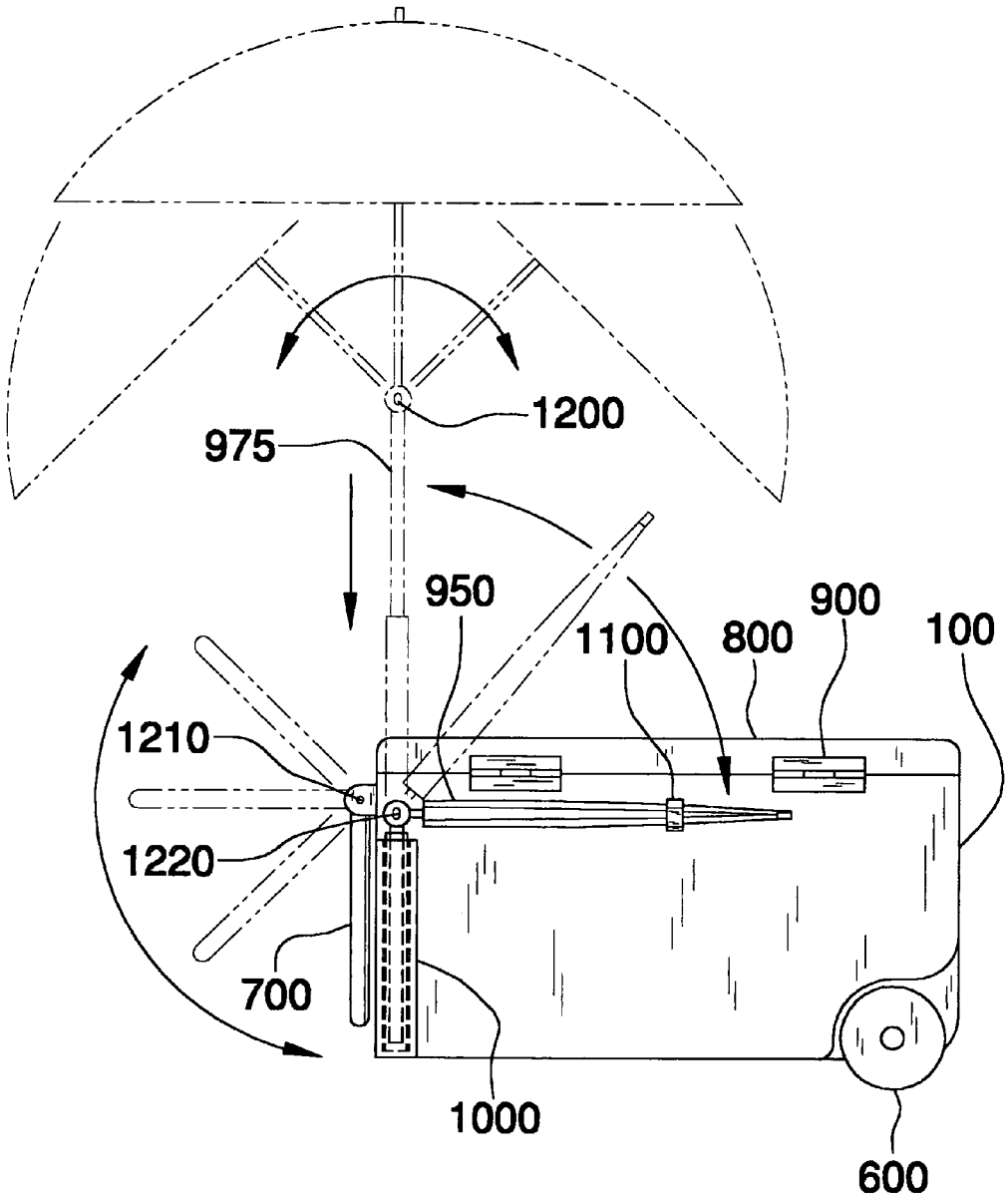
FIG. 3 is a view from the back showing the retraction of the umbrella.

FIG. 3 illustrates how the umbrella can be folded neatly into the umbrella housing 1000 or latch 1100 which is on the side in the approximate mid point of the back side panel of this particular device. The umbrella housing 1000 is a molded part of this device and houses the telescoping tube 975.

A pivot point 1200 on the umbrella allows the umbrella to be opened and closed. Another pivot point 1220 allows the now retracted or folded umbrella to fit in the umbrella holder or latch 1100. As the umbrella is folded it is folded according to rotation points.

A handle 700 has been provided to pull the device. In the ordinary position the handle will lie flush against the side of the device. A pivot mechanism 1210 allows the handle to rotate around the mechanism 1210 for the person to pull the device.

What is claimed is:

1. A device which combines additional features in a cooler and which is comprised of a. cooler, b. an AM/FM radio and CD player, c. speakers, d. bottle opener, e. umbrella, f. umbrella housing, g. telescoping tube, and h. means of access, wherein the cooler is a standard cooler and is molded as an integral, single piece;

wherein a lid is provided;

wherein the lid allows access to the items in the cooler;

wherein the means of access allows the user to put items into the cooler and take items from the cooler;

wherein said means of access is comprised of a plurality of latches and corresponding hinges;

wherein said AM/FM radio and CD player is positioned in the first side of the device;

wherein said speakers are on either side of the AM/FM radio and CD player located on the first side;

wherein said bottle opener is located on the front right hand corner of the first side of this device;

wherein said umbrella housing houses the telescoping tube;

wherein wheels have been provided;

wherein the handle allows a user to pull this device from the front.

2. The device as described in claim 1, wherein said means of access further allows rotation of the cooler lid to approximately a ninety degree angle.

3. The device as described in claim 1, wherein said telescoping tube further allows the height adjustment of the umbrella.

4. The device as described in claim 1, wherein the umbrella is opened and closed by use of a pivot point.

5. The device as described in claim 1, wherein the umbrella can be opened, closed, retracted and stowed in the umbrella holder or latch located on the back side panel of the cooler.

* * * * *